US011380298B2

(12) United States Patent
Hera et al.

(10) Patent No.: US 11,380,298 B2
(45) Date of Patent: Jul. 5, 2022

(54) SYSTEMS AND METHODS FOR TRANSITIONING A NOISE-CANCELLATION SYSTEM

(71) Applicant: Bose Corporation, Framingham, MA (US)

(72) Inventors: Cristian M. Hera, Lancaster, MA (US); Elie Bou Daher, Marlborough, MA (US); Siamak Farahbakhsh, Waltham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/782,676

(22) Filed: Feb. 5, 2020

(65) Prior Publication Data

US 2021/0241748 A1 Aug. 5, 2021

(51) Int. Cl.
*G10K 11/178* (2006.01)

(52) U.S. Cl.
CPC .. *G10K 11/17883* (2018.01); *G10K 11/17823* (2018.01); *G10K 11/17825* (2018.01); *G10K 11/17854* (2018.01); *G10K 2210/1282* (2013.01)

(58) Field of Classification Search
CPC ..... G10K 11/17883; G10K 11/17823; G10K 11/17825; G10K 11/17854; G10K 2210/1282
USPC ..... 381/71.4, 71.11
See application file for complete search history.

(56) References Cited

U.S. PATENT DOCUMENTS

| | | | | |
|---|---|---|---|---|
| 9,646,596 | B2 | 5/2017 | Tani et al. | |
| 9,870,763 | B1 | 1/2018 | Christian | |
| 2010/0098265 | A1 | 4/2010 | Pan et al. | |
| 2011/0142248 | A1 | 6/2011 | Sakamoto et al. | |
| 2012/0288110 | A1* | 11/2012 | Cherkassky ..... | G10K 11/17823 381/71.4 |

(Continued)

FOREIGN PATENT DOCUMENTS

JP H09218687 8/1997

OTHER PUBLICATIONS

International Search Report and the Written Opinion of the International Searching Authority, International Patent Application No. PCT/US2021/015078, pp. 1-10, dated May 12, 2021.

*Primary Examiner* — Vivian C Chin
*Assistant Examiner* — Friedrich Fahnert
(74) *Attorney, Agent, or Firm* — Bond, Schoeneck & King, PLLC

(57) ABSTRACT

A vehicle-implemented noise-cancellation system, includes: a noise-cancellation system disposed in a vehicle, the noise-cancellation system comprising an adaptive filter being adjusted according to a reference signal and an error signal, the adaptive filter outputting a noise-cancellation signal, which, when transduced into a noise-cancellation audio signal by a speaker, cancels road noise within at least one zone within a cabin of the vehicle; and an adjustment module configured to vary a power of the noise-cancellation signal or a rate of adaptation of the adaptive filter from a first value to a second value, passing through at least one intermediate value between the first value and the second value, based on a time-varying signal indicative of a signal-to-noise ratio of the reference signal with respect to a first criterion.

18 Claims, 14 Drawing Sheets

(56) References Cited

U.S. PATENT DOCUMENTS

2012/0308026 A1* 12/2012 Kamath ..... G10K 11/17817
381/71.11
2017/0076709 A1* 3/2017 Ku ..... G10K 11/17823

* cited by examiner

SYSTEMS AND METHODS FOR TRANSITIONING A NOISE-CANCELLATION SYSTEM

BACKGROUND

This disclosure is generally directed to systems and methods for transitioning a noise-cancellation output signal or rate of adaptation from a first value to a second value. Various examples are directed to systems and methods for smoothly transitioning a noise-cancellation or rate of adaptation from a first value to a second value.

SUMMARY

All examples and features mentioned below can be combined in any technically possible way.

In an aspect, a vehicle-implemented noise-cancellation system includes: a noise-cancellation system disposed in a vehicle, the noise-cancellation system comprising an adaptive filter being adjusted according to a reference signal and an error signal, the adaptive filter outputting a noise-cancellation signal, which, when transduced into a noise-cancellation audio signal by a speaker, cancels road noise within at least one zone within a cabin of the vehicle; and an adjustment module configured to vary a power of the noise-cancellation signal or a rate of adaptation of the adaptive filter from a first value to a second value, passing through at least one intermediate value between the first value and the second value, based on a comparison of a time-varying signal indicative of a signal-to-noise ratio of the reference signal to a first criterion.

In an example, the time-varying signal is at least one of: a speed of the vehicle, a power of the reference signal, revolutions per minute of an engine of the vehicle, gear position of an engine of the vehicle, and a measure of similarity between the outputs of at least two of the reference sensor signals.

In an example, the first criterion is at least one fixed threshold.

In an example, the first criterion is at least one variable threshold, the variation of the at least one variable threshold being based upon a second time-varying signal indicative of the signal-to-noise ratio of the reference signal.

In an example, the intermediate value is determined according to a predetermined function of the time-varying signal.

In an example, the predetermined function is a linear function.

In an example, the predetermined function is a logarithmic function.

According to another aspect, a vehicle-implemented noise-cancellation system includes: a noise-cancellation system disposed in a vehicle, the noise-cancellation system comprising an adaptive filter being adjusted according to a reference signal and an error signal, the adaptive filter outputting a noise-cancellation signal, which, when transduced into a noise-cancellation audio signal by a speaker, cancels road noise within at least one zone within a cabin of the vehicle; and an adjustment module configured to vary a power of the noise-cancellation signal or a rate of adaptation of the adaptive filter from a first value to a second value based on a comparison of a time-varying input indicative of a state of the vehicle or a measure of relationship between two or more reference sensors to a first criterion.

In an example, the state of the vehicle is at least one of: a speed of the vehicle, revolutions per minute of an engine of the vehicle, gear position of an engine of the vehicle.

In an example, the first criterion is at least one fixed threshold.

In an example, the first criterion is at least one variable threshold, the variation of the variable threshold being based upon a second time-varying signal indicative of the signal-to-noise ratio of the reference signal.

According to another aspect, a computer-implemented method for smoothly transitioning a vehicle-implemented noise-cancellation system from an off state to an on state, includes: receiving an input indicative of a signal-to-noise ratio of a reference sensor of the noise-cancellation system; comparing a value of the signal to a first threshold, wherein if a value of the signal is less than the first threshold a power of a noise-cancellation signal or a rate of adaptation of the noise-cancellation system is set to a first value, wherein if the value of the signal is greater than the first threshold, performing the step of: comparing the value of the signal to a second threshold, wherein if the value of the signal is greater than the second threshold, the power of the noise-cancellation or the rate of adaptation is set to a second value, wherein if the signal is greater than the first threshold and less than the second threshold the power of a noise-cancellation signal or the rate of adaptation is set to an intermediate value, wherein the second threshold is greater than the first threshold.

In an example, the input is at least one of: a speed of the vehicle, a power of the reference signal, revolutions per minute of an engine of the vehicle, gear position of an engine of the vehicle, and a measure of similarity between the outputs of at least two reference sensors.

In an example, the value of the intermediate value is determined according to a predetermined function of the input.

In an example, the predetermined function is a linear function.

In an example, the predetermined function is a logarithmic function.

In an example, the value of the first threshold and the second threshold are determined according to a second signal indicative of a signal-noise-ratio of the reference sensor.

In an example, the computer-implemented method further includes the steps of: receiving a second input indicative of a signal-to-noise ratio of the reference sensor; comparing a value of the second signal to a third threshold, wherein if a value of the signal is less than the third threshold the first threshold is set to a first threshold value, wherein if the value of the second signal is greater than the third threshold, performing the step of: comparing the value of the second signal to a fourth threshold, wherein if the value of the second signal is greater than the fourth threshold the first threshold is set to a second threshold value, wherein if the second signal is greater than the third threshold and less than the fourth threshold the first threshold is set to an intermediate value, wherein the second threshold is greater than the first threshold.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

An adaptive noise-cancellation system employs the use of at least one reference signal from a reference sensor in order to generate a noise-cancellation signal. If the noise-cancellation system is deployed in a vehicle, the reference sensors are typically accelerometers operably mounted to the vehicle to detect vibrations in the chassis, which are transduced by the chassis into what is perceived by a passenger as road noise. In some circumstances, such as at low speeds, the vibrations in the chassis are insufficient to produce an output that will cause the noise-cancellation system to adapt in a manner that better cancels noise in the vehicle cabin (stated differently, the signal-to-noise-ratio is too low to adapt the adaptive filter). In these instances, the noise-cancellation system adapts to the noise floor of the accelerometers rather than the vibrations of the vehicle chassis, which either degrades the performance of the noise-cancellation system or adds noise to the output of the speakers in the vehicle.

Various examples described in this disclosure are related to a vehicle-implemented noise-cancellation system that reduces or shuts off the noise-cancellation audio signal and/or slows or ceases adaptation of the noise cancellation system when the SNR of the accelerometers is too low to allow the noise-cancellation to adapt in a manner that better cancels in the noise in the vehicle cabin. In some of these examples, the road-noise cancellation system smoothly transitions from off state to an on state as the road noise in the cabin increases from zero, or from a negligible amount, to an amount detectable by the accelerometers. The smooth transition from an off state to an on state can include the steps of smoothly adjusting the gain of the noise-cancellation audio signal from zero to one through at last one intermediate value. The smooth transition from an off state to an on state can also include, in addition to or in place of transitioning the gain from zero to one, smoothly transitioning the noise-cancellation system from a state of no adaptation to a state of adapting to the accelerometer output.

Figure 1:
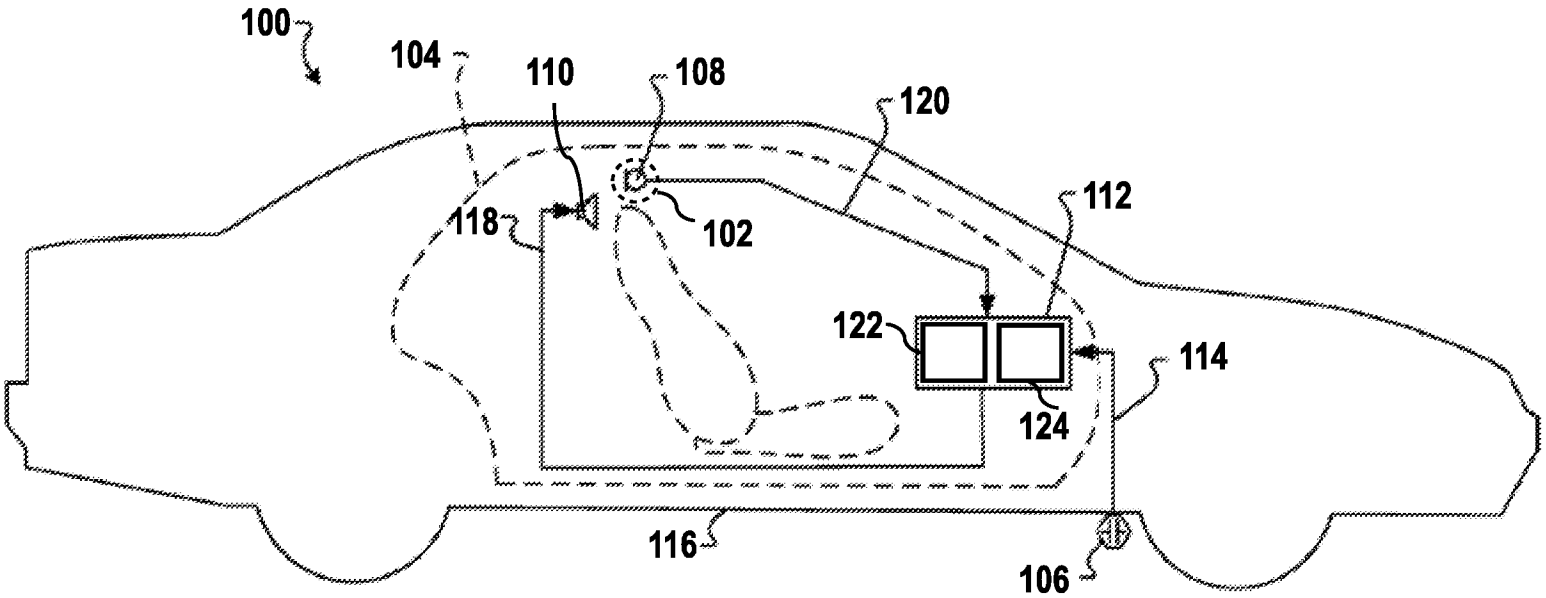
FIG. 1 depicts a schematic of a noise-cancellation system, according to an example.
Figure 2:
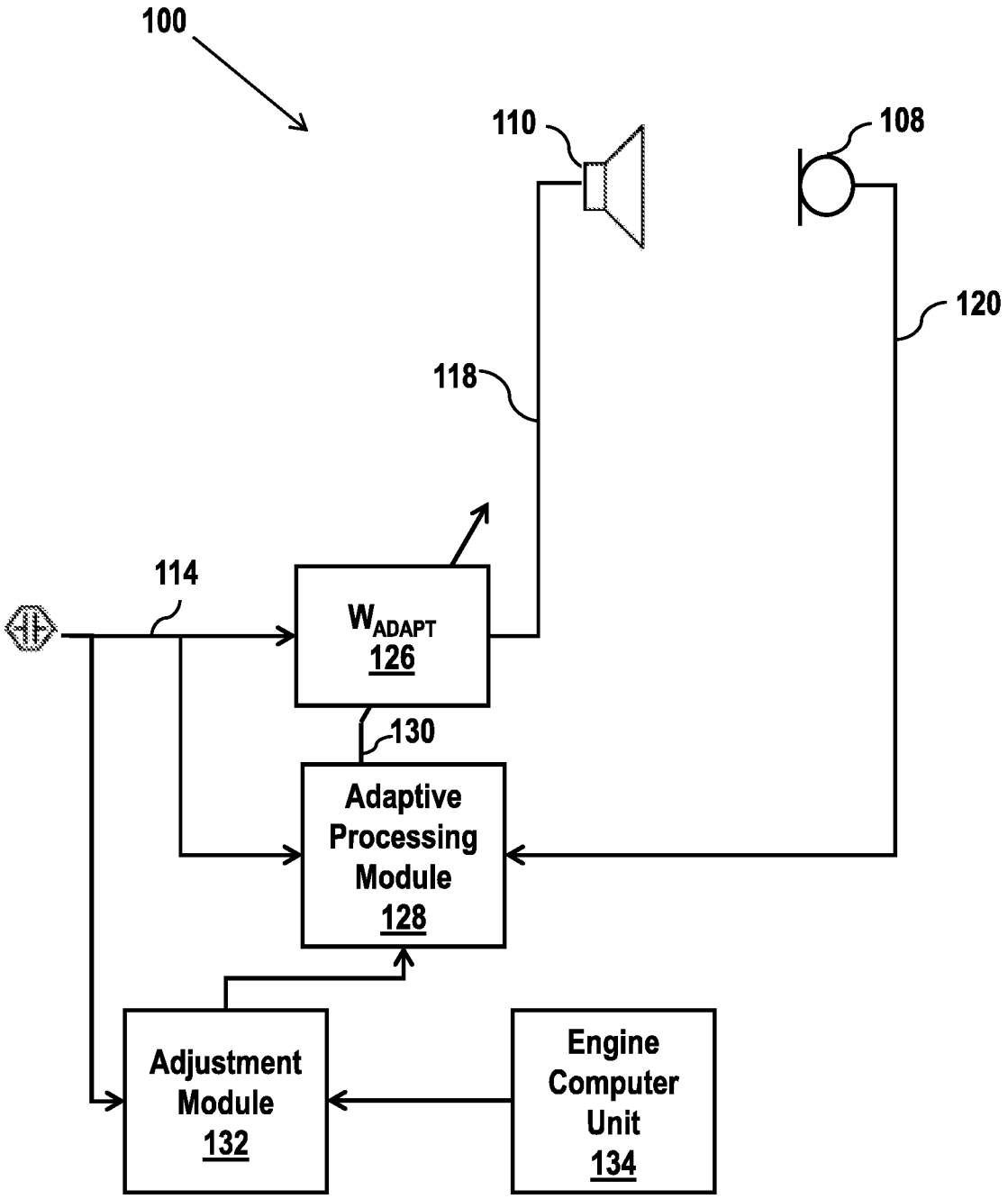
FIG. 2 depicts a block diagram of a noise-cancellation system, according to an example.

An example such of a vehicle-implemented noise-cancellation system will be briefly described, for purposes of illustration, in connection with FIGS. 1-2. FIG. 1 is a schematic view of an example noise-cancellation system 100. Noise-cancellation system 100 can be configured to destructively interfere with undesired sound in at least one cancellation zone 102 within a predefined volume 104 such as a vehicle cabin. At a high level, an example of noise-cancellation system 100 can include a reference sensor 106, an error sensor 108, an actuator 110, and a controller 112.

In an example, reference sensor 106 is configured to generate noise signal(s) 114 representative of the undesired sound, or a source of the undesired sound, within predefined volume 104. For example, as shown in FIG. 1, reference sensor 106 can be an accelerometer, or a plurality of accelerometers, mounted to and configured to detect vibrations transmitted through a vehicle structure 116. Vibrations transmitted through the vehicle structure 116 are transduced by the structure into undesired sound in the vehicle cabin (perceived as road noise), thus an accelerometer mounted to the structure provides a signal representative of the undesired sound.

Actuator 110 can, for example, be speakers distributed in discrete locations about the perimeter of the predefined volume. In an example, four or more speakers can be disposed within a vehicle cabin, each of the four speakers being located within a respective door of the vehicle and configured to project sound into the vehicle cabin. In alternate examples, speakers can be located within a headrest, or elsewhere in the vehicle cabin.

A noise-cancellation signal 118 can be generated by controller 112 and provided to one or more speakers in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise-cancellation within one or more predefined cancellation zones 102 with the predefined volume. The noise-cancellation within the cancellation zones can effect a reduction in undesired sound by approximately 3 dB or more (although in varying examples, different amounts of noise-cancellation can occur). Furthermore, the noise-cancellation can cancel sounds in a range of frequencies, such as frequencies less than approximately 350 Hz (although other ranges are possible).

Error sensor 108, disposed within the predefined volume, generates an error sensor signal 120 based on detection of residual noise resulting from the combination of the sound waves generated from the noise-cancellation signal 118 and the undesired sound in the cancellation zone. The error sensor signal 120 is provided to controller 112 as feedback, error sensor signal 120 representing residual noise uncanceled by the noise-cancellation signal. Error sensors 108 can be, for example, at least one microphone mounted within a vehicle cabin (e.g., in the roof, headrests, pillars, or elsewhere within the cabin).

It should be noted that the cancellation zone(s) can be positioned remotely from error sensor 108. In this case, the error sensor signal 120 can be filtered to represent an estimate of the residual noise in the cancellation zone(s). In either case, the error signal will be understood to represent residual undesired noise in the cancellation zone.

In an example, controller 112 can comprise a nontransitory storage medium 122 and processor 124. In an example, non-transitory storage medium 122 can store program code that, when executed by processor 124, implements the various filters and algorithms described below. Controller 112 can be implemented in hardware and/or software. For example, the controller can be implemented by a SHARC floating-point DSP processor, but it should be understood that controller 112 can be implemented by any other processor, FPGA, ASIC, or other suitable hardware.

Turning to FIG. 2, there is shown a block diagram of an example of noise-cancellation system 100, including a plurality of filters implemented by controller 112. As shown, the controller can define a control system including $W_{adapt}$ filter 126 and an adaptive processing module 128.

$W_{adapt}$ filter 126 is configured to receive the noise signal 114 of reference sensor 106 and to generate noise-cancellation signal 118. Noise-cancellation signal 118, as described above, is input to actuator 110 where it is transduced into the noise-cancellation audio signal that destructively interferes with the undesired sound in the predefined cancellation zone 102. $W_{adapt}$filter 126 can be implemented as any suitable linear filter, such as a multi-input multi-output (MIMO) finite impulse response (FIR) filter. $W_{adapt}$ filter 126 employs a set of coefficients which define the noise-cancellation signal 118 and which can be adjusted to adapt to changing behavior of the vehicle response to road input (or to other inputs in non-vehicular noise-cancellation contexts).

The adjustments to the coefficients can be performed by an adaptive processing module 128, which receives as inputs the error sensor signal 120 and the noise signal 114 and, using those inputs, generates a filter update signal 130. The filter update signal 130 is an update to the filter coefficients implemented in $W_{adapt}$ filter 126. The noise-cancellation signal 118 produced by the updated $W_{adapt}$ filter 126 will minimize error sensor signal 120, and, consequently, the undesired noise in the cancellation zone.

The coefficients of $W_{adapt}$ filter 126 at time step n can be updated according to the following equation:

$$W_{adapt}[n+1] = W_{adapt}[n] + \mu(\tilde{T}'_{de} * e)\frac{x}{\|x\|_2} \quad (1)$$

where $\tilde{T}_{de}$ is an estimate of the physical transfer function between actuator 110 and the noise-cancellation zone 102, $\tilde{T}'_{de}$ is the conjugate transpose of $\tilde{T}_{de}$, e is the error signal, and x is the output signal of reference sensor 106. In the update equation, the output signal x of reference sensor is divided by the norm of x, represented as $\|x\|_2$.

In application, the total number of filters is generally equal to the number of reference sensors (M) multiplied by the number of speakers (N). Each reference sensor signal is filtered N times, and each speaker signal is then obtained as a summation of M signals (each sensor signal filtered by the corresponding filter).

Noise-cancellation system 100 further includes an adjustment module 132 configured to vary at least one of a power of the noise-cancellation signal 118 and rate of adaptation of the adaptive filter $W_{adapt}$ filter 126 as implemented by the adaptive processing module 128 in response to a signal received from the reference sensor 106 or an input from the engine computer unit 134. The adjustment module can be implemented according to one of the various methods described in connection with FIGS. 3-8.

Again, the noise-cancellation system 100 of FIGS. 1 and 2 is merely provided as an example of such a system. This system, variants of this system, and other suitable noise-cancellation systems can be used within the scope of this disclosure. For example, while the system of FIGS. 1-2 has been described in conjunction with a least-means-squares filter (LMS), in other examples a different type of filter, such as one implemented with a recursive-lease-squares (RLS) filter can be implemented.

FIGS. 3-8 depict flowcharts and associated graphs of computer-implemented methods for adjusting the output and/or adaptation of a vehicle-implemented noise-cancellation system when the SNR of the accelerometer is too low to allow to adapt the noise-cancellation system in a manner that better cancels the noise in the vehicle cabin. The computer-implemented methods described in connection with FIGS. 3-8 can be implemented by a controller, such as a controller 112, or by any computing device suitable for carrying out the methods described in connection with FIGS. 3-8.

Figure 3A:
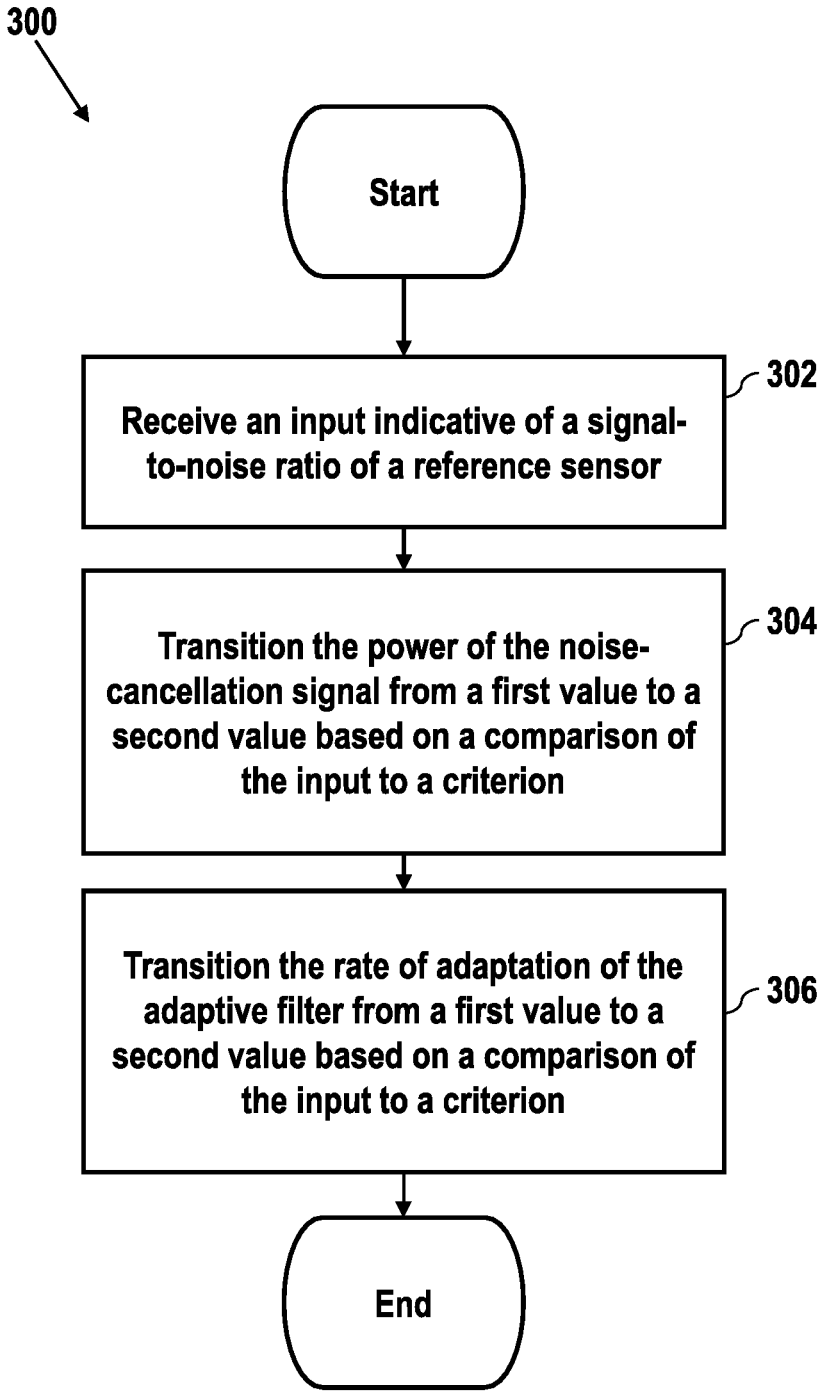
FIG. 3A depicts a flowchart of a method for transitioning the noise-cancellation signal from a first value to a second value, according to an example.

FIG. 3A depicts a high-level flowchart of a method for adjusting the output and adaptation of the vehicle-implemented noise-cancellation system. Steps 302-306 generally require receiving a time-varying input representative of a signal-to-noise ratio of at least one reference sensor and transitioning the power of the noise-cancelation signal and a rate of adaptation of the noise-cancellation system from a first level to a second level (e.g., from an off state to an on state) according to a comparison of the input to a criterion. In an example, and as will be described below, the criterion can be a fixed or variable threshold against which the input is compared. If the value of the input is below the threshold, typically indicating that the SNR of the reference sensor is too low to adapt the adaptive filter, then the noise-cancellation signal and/or adaptation is set to an off state. If the input is above the threshold, the noise-cancellation signal and/or adaptation are set to an on state.

At step 304, an input indicative of the signal-to-noise ratio a reference sensor is received. For the purposes of this disclosure, a reference sensor is any sensor generating noise signals representative of the undesired sound, or a source of the undesired sound, within a predefined volume and used to update the adaptive filter of the noise-cancellation system.

The input indicative of the signal-to-noise ratio of at least one reference sensor can be any signal (or set of signals) which has a positive correlation with the signal-to-noise ratio of the reference sensor in a vehicular context. Examples of a such a signal include signals that relate to the state of a vehicle such as the speed of the vehicle, revolutions per minute of the vehicle engine, or gear position of the vehicle engine, all of which generally increase as the signal-to-noise ratio of the reference sensor(s) improves. These inputs of the state of the vehicle can be received from the engine computer unit (e.g., engine computer unit 134 shown in FIG. 2) via the CAN bus of the vehicle.

Furthermore, the input indicative of the signal-to-noise ratio of at least one reference sensor can be the result of preliminary processing of the output reference sensor(s). For example, the input can be a power of the noise signal output by the reference sensor(s). In such an example, the input requires a preliminary step of finding a power of the sensor signal, such as by finding the power spectral density or average, across frequency and/or time, of a power spectral density of the sensor signal. For this preliminary step, any suitable method of finding the power spectral density of a reference sensor can be used. For example, the combined PSD of multiple reference sensors can be defined as follows.

$$PSD(x, n) = \sum_{j=1}^{N_{ref}} \sum_{k=1}^{N_f} w_{j,k} \cdot S_{x_j x_j}(n, k), \tag{2}$$

where PSD(x, n) is a combined power spectral density of all reference sensor signals at time n, $N_{ref}$ is the total number of reference sensors used for road noise cancellation (alternatively, a subset of reference sensors can be used), and $w_{j,k}$ is the weight associated with the jth reference sensor and kth frequency bin. The coefficients $w_{j,k}$ determine which reference sensors and which frequency intervals are taken into consideration. Stated differently, the reference sensor outputs can be weighted differently and/or certain frequencies can be weighted differently according to relevance. For example, a range of frequencies of interest can be used. Road noise is typically below 400 Hz, and so, in one example, only the power below 400 Hz is used.

$S_{x_j x_j}(n, k)$, the PSD estimate of the jth reference sensor at frequency bin k and time index n, can computed as:

$$S_{x_j x_j}(n,k)=(1-\alpha)\cdot|X_j(n,k)|^2+\alpha\cdot Sx_jx_j(n-1,k) \tag{3}$$

where $X_j(n, k)$ is the frequency domain value of the jth accel at frequency bin k and time index n, and $\alpha$ is the forgetting factor. This is merely provided as an example of a method of finding a PSD of a given reference sensor, as such, in alternative examples, any other suitable method for finding a PSD can be used.

As described above, the time-varying input can be the combined (i.e., summed) PSD of a plurality of reference sensors. An example of the combined PSD of multiple accelerometers is shown in graph of FIG. 4A across multiple vehicle states and road surfaces including: the vehicle being in an off state, the input at zero mph, smooth pavement at 5 mph, smooth pavement at 10 mph, a gravel road at 5 mph, and a gravel road at 10 mph. In this example amplitude over frequency may be used. Alternatively, the PSD can be averaged across frequencies or a range of frequencies, rendering a single power value, which can be evaluated according to the criterion. Alternatively, the power of each frequency bin of the PSD can be compared to the criterion, which will be described in connection with FIG. 3.

In an alternative example, the plurality of PSDs can be averaged on a frequency-by-frequency basis. This can be shown in FIG. 4B, again for a variety of vehicle states and road surfaces including: the vehicle being in an off state, the input at zero mph, smooth pavement at 5 mph, smooth pavement at 10 mph, a gravel road at 5 mph, and a gravel road at 10 mph. In an alternative example, the PSD of a single reference sensor can be used. In yet another example, the method described in connection with FIG. 3 can be repeated for each of the reference sensors, each time using a value related to the PSD of a different reference sensor. In other words, the method described in connection with FIG. 3 can be repeated for each individual reference sensor, each iteration of the method comparing the PSD of the individual sensor to a criterion.

Instead of (or in addition to) relying on the power of the reference sensor signal, a value indicative of a measure of similarity between reference sensor signals can be used. Such measures of similarity include, for example, coherence or correlation between reference sensor signals. Because there is no similarity between the noise floors of the various reference sensors, the measure of similarity between sensors when the vehicle is stationary will be approximately zero. By contrast, when the vehicle is in motion, there will be some measurable similarity between the reference sensor signals because the vibrations throughout the vehicle cabin are related. Thus, the measure of similarity between the reference sensor signals will be positively correlated with the signal-to-noise ratio of the reference sensor signals because there will typically only be some similarity between the reference sensor signals when there is a signal output rather than only noise.

For example, the coherence is a measure of a linear relationship between the reference sensors. Because the noise output of each reference sensor is unrelated, the coherence between reference sensors when the vehicle is stationary will be approximately zero. Once the vehicle begins to move, however, and vibrations are transmitted through the vehicle chassis, the coherence between the sensors will reach some positive value because the vibrations at different points of the vehicle will be related. Theoretically, if the vibrations transmitted through the vehicle were identical, the coherence between reference sensors would equal one. However, because the wheels of the vehicle do not vibrate in the same way, and because vibrations are not transmitted through the vehicle in the same way, the coherence between reference sensors while the vehicle is moving will be some value between zero and one.

In one example, the aggregate coherence between a plurality of reference sensors can be expressed as:

$$C(x, n) = \sum_{s=1}^{N_{sets}} \sum_{l=1}^{N_{ref}} \sum_{k=1}^{N_f} w_{s,l,k} \cdot C_{\{X\}_s x_l}(n, k), \tag{4}$$

where $w_{s,l,k}$ determines which sets of reference sensors are considered in the computation of the multi coherence $C_{\{x\}_s x_l}$ between a set $\{x\}_s$ and a single reference sensor l, and which range of frequency bins. A subset of frequencies (e.g., below 400 Hz) can be used.

Similarly, the correlation between two or more sensors can be used. Generally, coherence is more desirable because coherence is normalized; however, it should be understood that any suitable measure of similarity can be used as the input.

Returning to FIG. 3A, at step 304, the gain of the noise-cancellation signal transitions from a first value (e.g., zero) to a second value (e.g., unity), causing the power of the noise cancellation signal to transition from a first value to a second, based on a comparison of the input representative of the SNR of the reference sensor(s) to a criterion. In alternate examples, the criterion can be a fixed threshold or a variable threshold. Thus, the power of the noise-cancellation signal is transitioned from the first value to the second value upon determining that the input is above the fixed or variable threshold.

In an example, the power can be varied from the first value to the second value by varying the gain of the noise-cancellation signal. This is shown by the following equation:

$$b(n)=G_{input}(n)\cdot b_{in}(n) \tag{5}$$

where $b_{in}(n)$ is the road noise cancellation signal that was generated by the adaptive filter and $G_{input}(n)$ is a gain that is computed as follows:

$$G_{input}(n)=\begin{cases}0, & INP_1(n)\le I_1(n)\\ 1, & INP_1(n)>I_1(n)\end{cases} \tag{6}$$

In other words, the gain is set to 0 and the noise-cancellation signal is, accordingly, switched off when the value of the time-varying input (denoted as $INP_1(n)$) is less than or equal to the threshold $I_1$, and the gain is set to unity and the noise-cancellation signal is sent to the speaker without attenuation when the time-varying input is above threshold $I_1$. The power of the noise-cancellation signal is accordingly varied from zero to a second value that represents the unattenuated noise-cancellation signal. In an alternative embodiment, rather than zero, the gain can be set to some value that would result in a noise-cancellation signal of negligible power (i.e., one that is not perceptible to a user). Typically, the unattenuated noise-cancellation signal will be some value that results in the maximum allowable cancellation of the noise signal. In another example, however, the first value can be some predetermined non-zero value. Even if the noise level is too low to adapt the adaptive filter, a noise-cancellation signal can be still be played, the adaptive filter, not yet adapting, behaving like a fixed filter (having some set of predetermined or previously-stored coefficients). In this case, the first value may be some small gain value that results in the cancelling of minor road noise in the vehicle cabin during driving at low speeds over most road surfaces.

Generally, the threshold $I_1$ is set to be the minimum value for which the noise-cancellation signal is generated. In the example of input of vehicle speed, threshold $I_1$ would be set to some speed value for which there is road noise in the vehicle cabin (e.g., 10 mph) that can be cancelled by the noise-cancellation audio signal. It should be understood that the threshold value will be dependent on the type of input selected (e.g., vehicle speed, coherence, etc.).

Figure 3B:
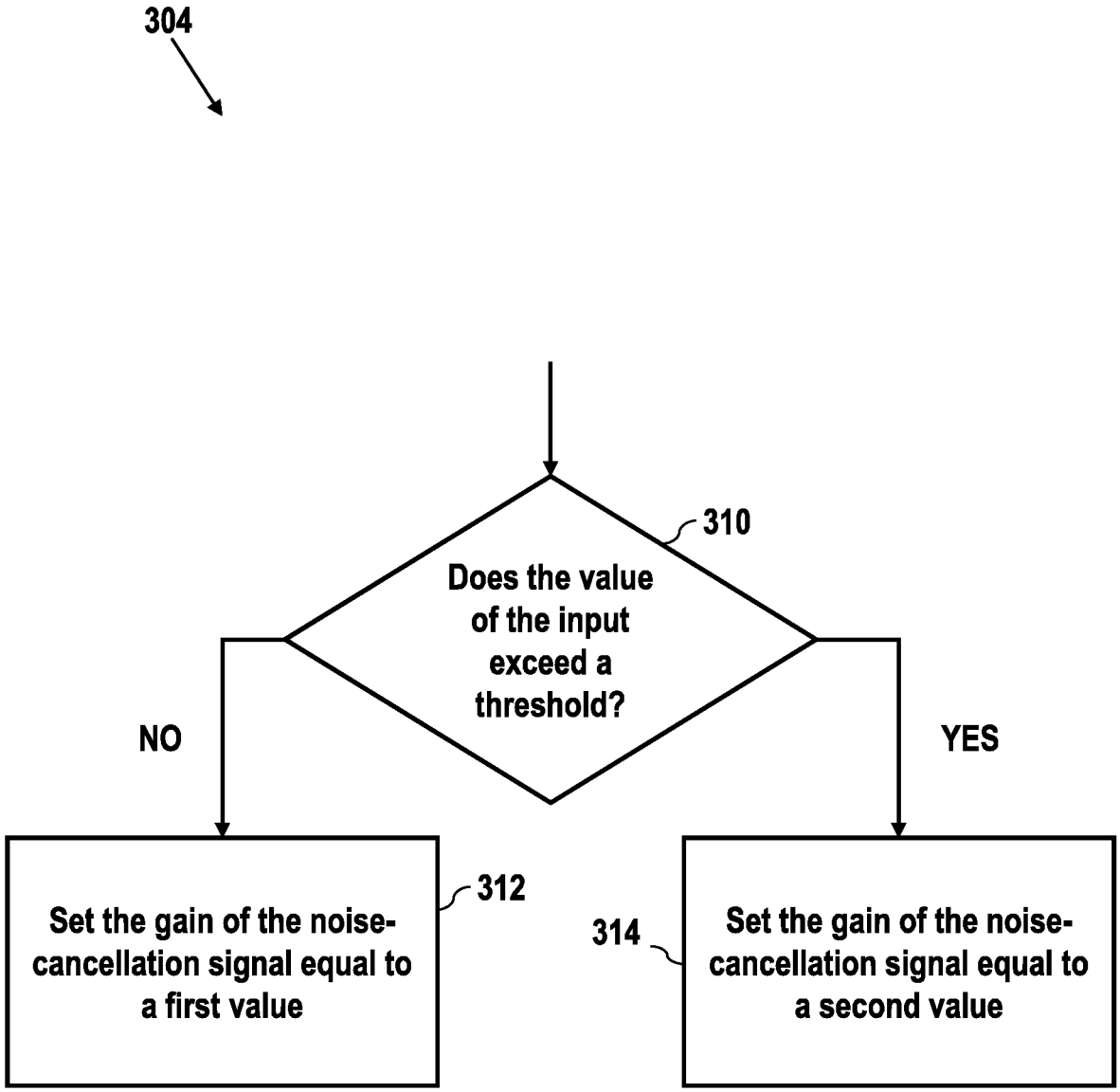
FIG. 3B depicts a flowchart of a method for transitioning the noise-cancellation signal from a first value to a second value, according to an example.

FIG. 3B shows an example flowchart of step 304, in which the input is compared to the threshold. At step 310 the input (described in connection with step 302) is compared to a fixed threshold (e.g., vehicle speed of ten miles per hour). This is represented by the condition block asking whether the input exceeds the threshold. If the answer to this conditional is no, at step 312, the gain of the noise-cancellation signal is set to the first value (e.g., zero or some negligible amount); whereas, if the answer to this conditional is yes the noise-cancellation signal is set, at step 314, to the second value (e.g., setting the noise-cancellation signal to unity gain).

Returning to FIG. 3A, concurrently with step 304, or at some point thereafter, the rate of adaptation of the noise-cancellation system, which is typically updated through the adaptation module, transitions from a first value (e.g., zero) to a second value (e.g., unity) based on the comparison of the input representative of the SNR of the reference sensor(s) to a criterion. In an example, this can be implemented by varying the step size gain of the update equation used by the adaptive processing module to update the adaptive filter. When the step size is zero, the adaptive processing module will not update the coefficients of the adaptive filter. When the step size gain is at unity, the rate of adaptation set to some optimum level for updating the coefficients of the adaptive filter.

In an example, the rate of adaptation of the noise-cancellation filter can be varied according to the following equation:

$$\mu(n)=\mu_0\cdot\mu_{input}(n) \tag{7}$$

where $\mu_0$ is the maximum allowable step size of the adaptive filter and $\mu_{input}(n)$ is an input dependent step size gain that can be calculated as follows $$\mu_{input}(n)=\begin{cases}0, & INP_1(n)\le I_1(n)\\ 1, & INP_1(n)>I_1(n)\end{cases} \tag{8}$$

In this example, the step size gain is zero when the input is less than or equal to the threshold $I_1$ and equal to unity when the input is greater than the threshold $I_1$. Accordingly, the adaptive filter ceases adaptation when the input is below the threshold and begins to adapt the adaptive filter when the input is above the threshold.

Figure 3C:
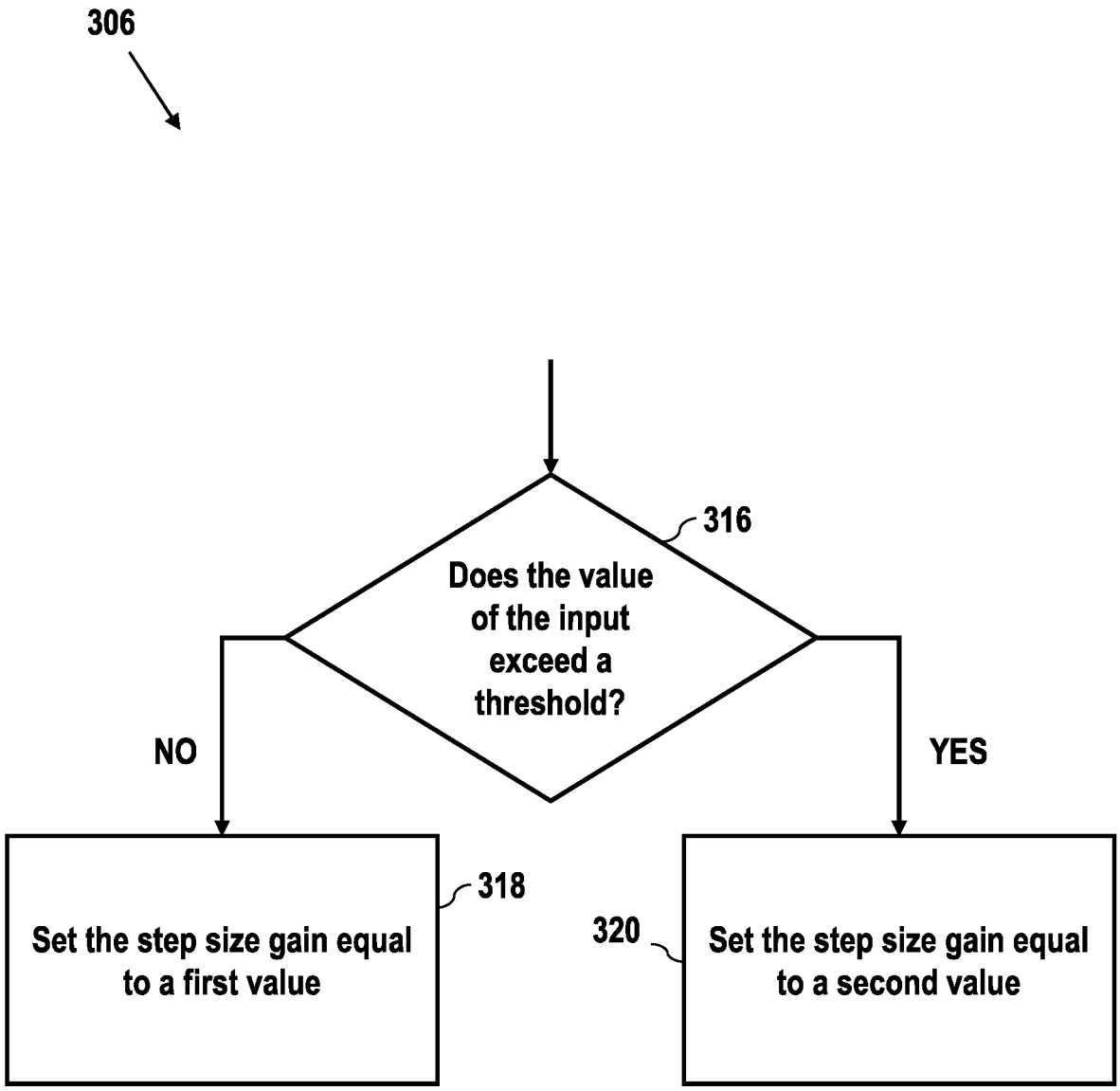
FIG. 3C depicts a flowchart of a method for transitioning the rate of adaptation of the adaptive filter from a first value to a second value, according to an example.

FIG. 3C shows an example flowchart of step 306 of method 300. At step 316, the input signal is received and compared to the threshold. If the input signal (e.g., vehicle speed) is less than the threshold (e.g., 10 mph) then the step size gain is set to a first value (e.g., zero) at step 318; if, however, the signal is greater than the threshold then the step size gain is set to a second value (e.g., unity) at step 320.

Figure 5:
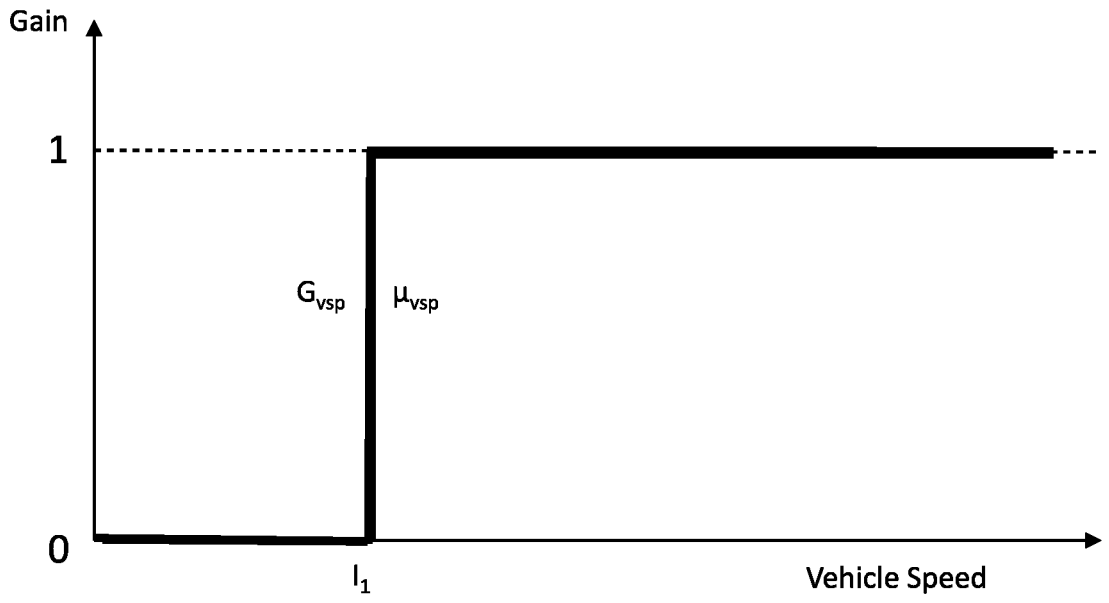
FIG. 5 depicts a graph of transitioning the gain of the noise-cancellation signal and step size from a first value to a second value, according to an example.

FIG. 5 shows a graph of the gain of the noise-cancellation signal and step size as a function of vehicle speed (one example input). As shown, the gain is set to 0 until the vehicle speed reaches the threshold $I_1$ when the gain of both the noise-cancellation signal and step size are set to unity.

Generally speaking, the adaptation occurs concurrently with the production of the noise-cancellation signal, and so the threshold for beginning adaptation is the same as the threshold for beginning production of the noise-cancellation signal. It is not desirable to begin adaptation of the adaptive filter before the production of the noise-cancellation audio signal because the update equation relies on an error signal that presumes full operation of the noise-cancellation system. In other words, if the adaptation begins before the production of the noise-cancellation audio signal, the update equation will update as though the noise-cancellation audio signal is playing but is failing to cancel any of the undesired sound in the vehicle cabin, thus the adaptive filter will be incorrectly updated. However, in various alternative embodiments, adapting the adaptive filter could occur at some point after the start of production of the noise-cancellation signal. In one example, the input could be compared to a different, higher, threshold. For example, if the input is vehicle speed, the adaptation could begin at some speed higher than the speed for which the production of noise-cancellation audio signal begins. In a simpler example, the adaptation of the adaptive filter could begin some predetermined interval of time (e.g., one second) after the start of production of the noise-cancellation signal, rather than relying on a threshold.

It will be understood that, before the adaptive filter is adapted, the adaptive filter will behave like a fixed filter. In this circumstance, the coefficients of the (fixed) adaptive filter can be set to some default value of coefficients that produces road-noise cancellation for most road surfaces, or to some previously stored set of coefficients.

The above examples described in connection with FIGS. 3A-3C compare the input to a fixed threshold. A fixed threshold, however, in certain circumstances, can fail to appropriately capture the actual SNR of the reference sensor(s) (even if the input is correlated to the SNR of the reference sensor(s)). For example, while an input of vehicle speed can accurately represent the road noise for most road conditions, it will fail to represent the road noise in rough road conditions (e.g., if the vehicle is driving over cobblestone). Thus, a second input, such as a power of the reference sensor, can be analyzed to determine the threshold for which to analyze the first input. In other words, the threshold against which the first signal (e.g., the speed of the vehicle) is compared, can itself be determined by comparing a second input (e.g., power of the reference sensor(s)) against a second threshold, as follows:

$$I_1(n) = \begin{cases} I_{1_{max}}, & INP_2(n) \le I_{var1} \\ I_{1_{min}}, & INP_2(n) > I_{var1} \end{cases} \tag{9}$$

where $INP_2$ (n) is a second input, $I_{1max}$ is a first threshold value of the first threshold $I_1$ and $I_{1min}$ is a second threshold value of the first threshold $I_1$, $I_{par1}$ is the variance threshold (i.e., the threshold against which the second input is compared to determine the variation of the first threshold). Typically, the first threshold value $I_{1max}$ will be higher than the second threshold value $I_{1min}$ (here, the subscripts "max" and "min" refer to the maximum values that to which the thresholds are set, not the maximum possible and minimum possible values of the thresholds). More specifically, the variance threshold $I_{var1}$ can be set so that, on paved road surfaces, the power of the reference sensor is insufficient to move the first threshold to a lower value but can be set so that in rough road conditions the second input $INP_2$ (n) will exceed the variance threshold $I_{par1}$ and accordingly set the first threshold to the second threshold value $I_{1min}$. Thus, in normal driving conditions, the first input $INP_1$(n) will be compared to the first threshold value while in rough road conditions the first input $INP_1$(n) will be compared to the second threshold value $I_{1min}$. This compensates for instances in which the first threshold fails to adequately represent the signal-to-noise ratio of the reference sensor. Because the second input is a different type of input than the first input, the second threshold will typically be different from the first threshold.

Figure 3D:
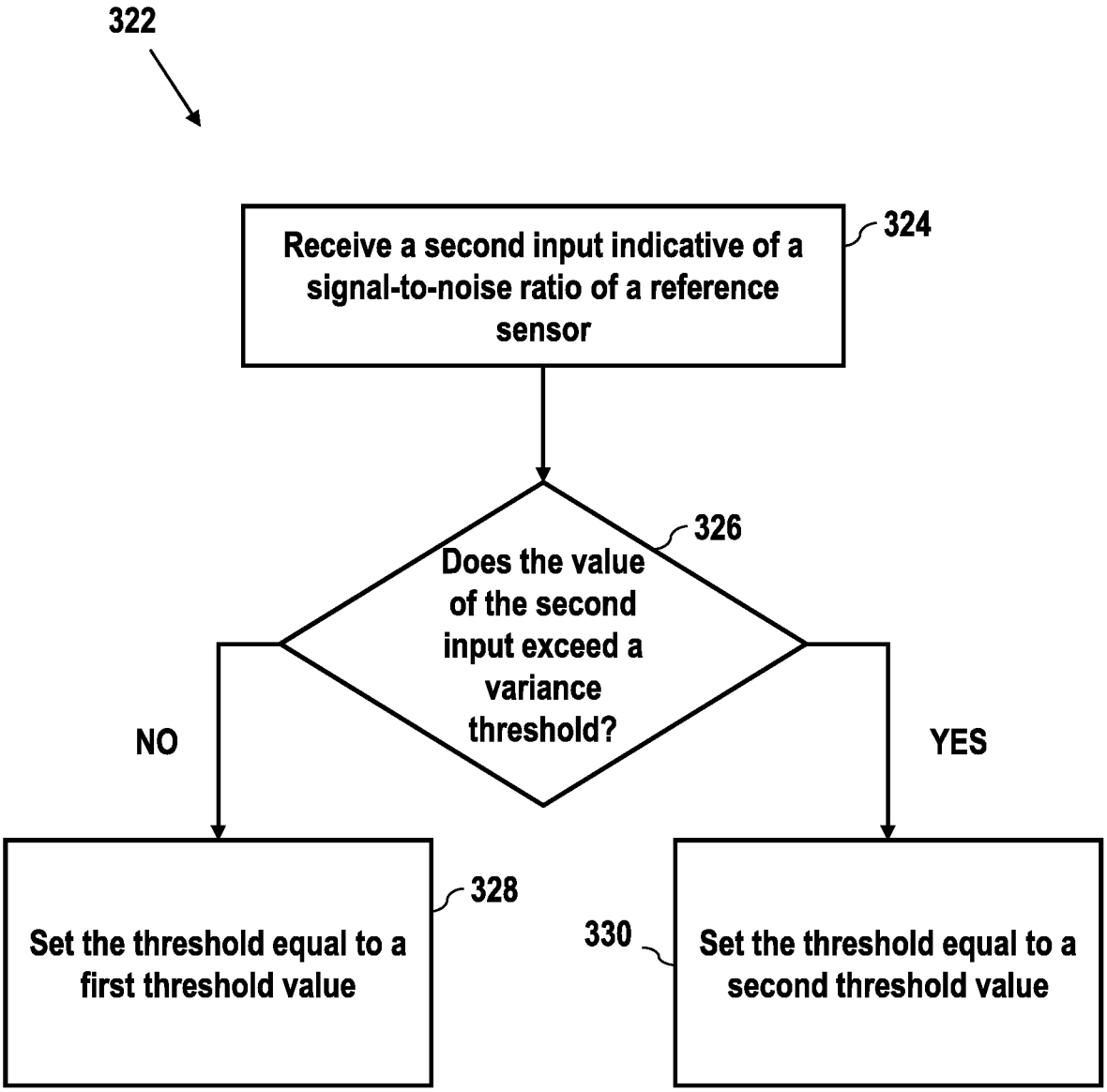
FIG. 3D depicts a flowchart of a method for varying the threshold to transition the noise-cancellation signal or rate of adaptation, according to an example.
Figure 4A:
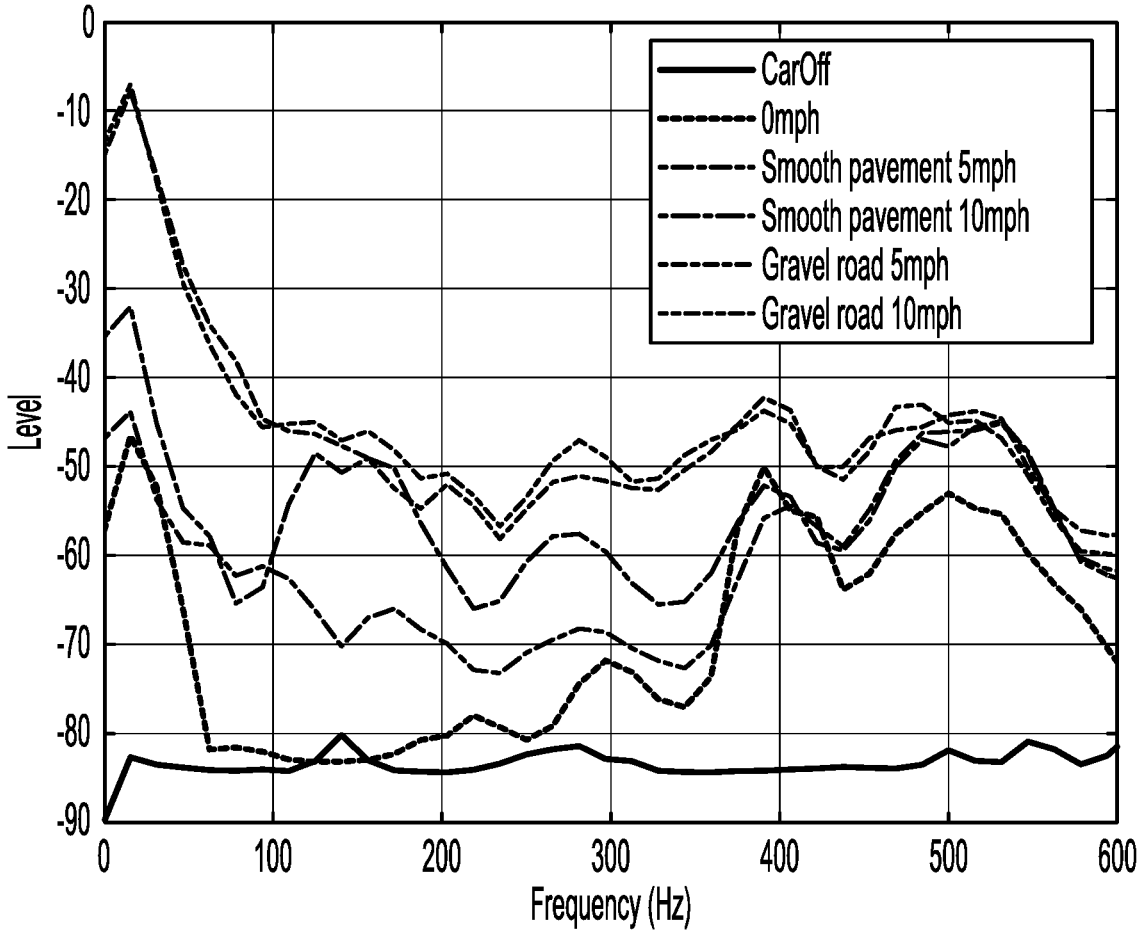
FIG. 4A depicts a graph of a combined power spectral density of multiple reference sensors, according to an example.
Figure 4B:
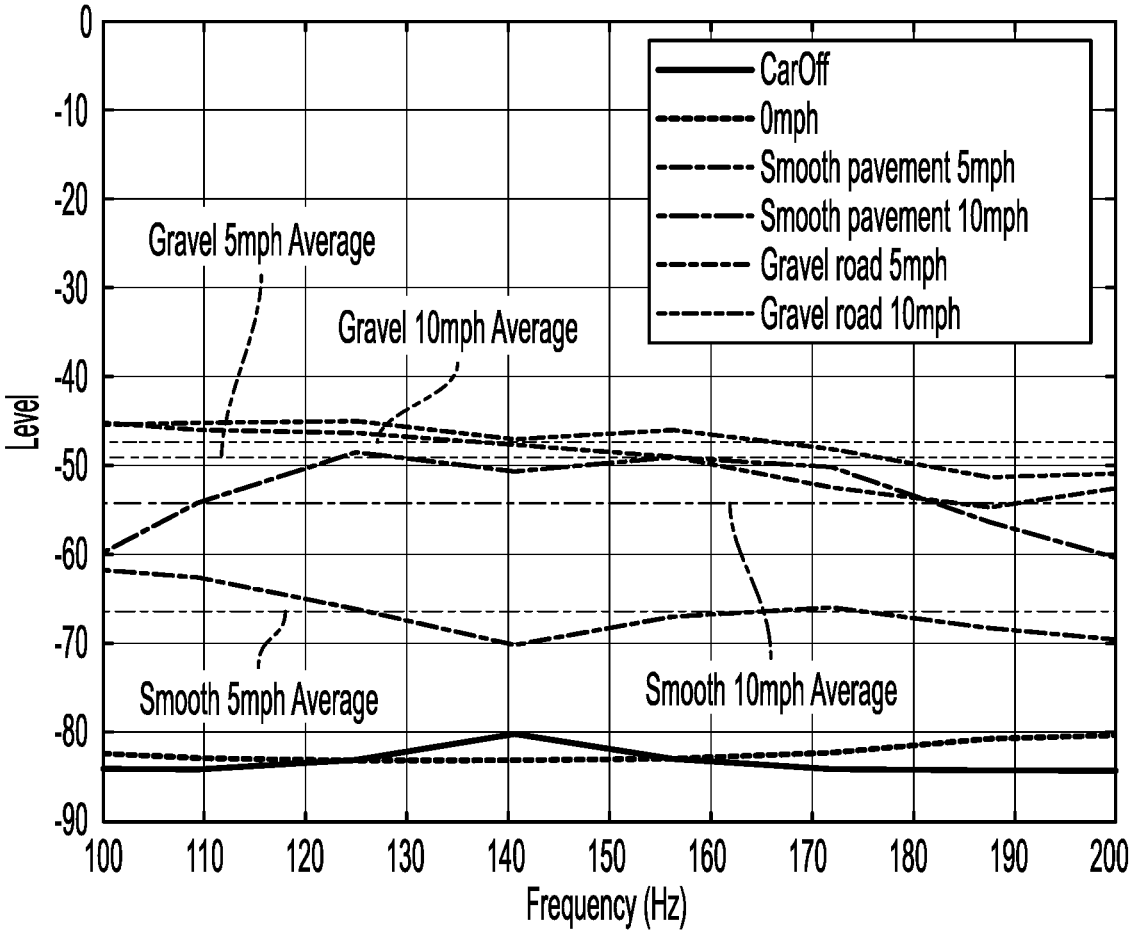
FIG. 4B depicts a graph of an averaged power spectral density of multiple reference sensors, according to an example.

FIG. 3D depicts a flowchart of method 322 for varying the threshold of FIGS. 3B and 3C to accommodate for varying road conditions. Generally, the method 322 described in connection with FIG. 3D is run before the steps of comparing the first input to the first threshold; however, as the method described in connection with FIGS. 3B and 3C is typically looped over multiple samples, the steps of FIG. 3D can be run after the steps of FIGS. 3B and 3C.

At step 324 a second input is received. This input can be one of the inputs described in connection with FIG. 3A step 302, however it must be a different type of input than the input compared against the threshold in steps 304 and/or 306. For example, if vehicle speed is used for step 304, then, for example, the power of the reference sensor(s) signal(s) or measure of similarity between the reference sensors signals can be used for the second input.

At step 326, the second input is compared against the variance threshold at the conditional block 326. If the second input is below the variance threshold, then the threshold is maintained at a first threshold value at step 328. If, however, the second input is above the variance threshold, the first threshold is set to a second threshold value at step 330. The second threshold value is typically less than the first threshold value, because the higher value of the second input is indicative of a secondary condition (e.g., rough road conditions) that could be adding noise to the vehicle cabin.

The above-described methods account for situations in which the SNR of the reference sensor is too low to update the adaptive filter. However, abruptly turning on the noise-cancellation signal can be noticeable and jarring to a user. Accordingly, a method for smoothly transitioning the noise-cancelation signal and/or the rate of adaptation from a first value (e.g., an off state) to a second value (e.g., an on state) is described in connection with FIG. 6A.

Like the method described in connection with FIG. 3A, at step 602, an input indicative of a SNR of at least one reference sensor is received. The input can be any input which correlates to the signal-to-noise ratio of at least one reference sensor. Examples of such inputs are described in connection with step 302.

At step 304, the power of the noise-cancellation signal smoothly transitions from the first value (e.g., zero) to the second value (e.g., unity gain) based on a comparison of the input representative of the reference sensor(s) to a criterion. Smoothly transitioning requires passing through at least one intermediate value between the first value and the second value, although it is contemplated that the power of the noise-cancellation signal could transition through multiple intermediate values on its way from the first value to the second value. The value of the intermediate value can fixed or can be determined by a function.

For example, the power can be varied from the first value to the second value by varying the gain of the noise-cancellation signal. This is shown by the following equation:

$$b(n)=G_{input}(n)\cdot b_{in}(n) \tag{10}$$

where $b_{in}$(n) is the road noise cancellation signal that was generated by the adaptive filter and $G_{input}$(n) is a gain that is computed as follows:

$$G_{input}(n) = \begin{cases} 0, & INP_1(n) \le I_1(n) \\ \dfrac{INP_1(n) - I_1(n)}{I_2(n) - I_1(n)}, & I_1(n) < INP_1(n) < I_2(n) \\ 1, & INP_1(n) \ge I_2(n) \end{cases} \tag{11}$$

The gain is thus set to 0, and the noise-cancellation signal is, accordingly, switched off (or, alternatively, set to some negligible value or some other predetermined value) when the value of the time-varying input $INP_1$(n) is below or equal to the first threshold value $I_1$ and is set to unity when time-varying input is above a second threshold $I_2$. However, when the input is between first threshold and the second threshold, the noise-cancellation signal gain is defined by an equation that linearly varies the between the first value and the second value. Thus, in this example, the gain varies linearly between the first value and the second value, smoothly transitioning the noise-cancellation signal from an off state to an on state.

In an alternative example, the intermediate value can be a fixed value. For example, rather than setting the intermediate value according to a linear equation, the intermediate value can be some fixed value (e.g., 0.5 gain) between the first value and the second value. In yet another example, a different function, such as a logarithmic function, can define the intermediate values.

Figure 6A:
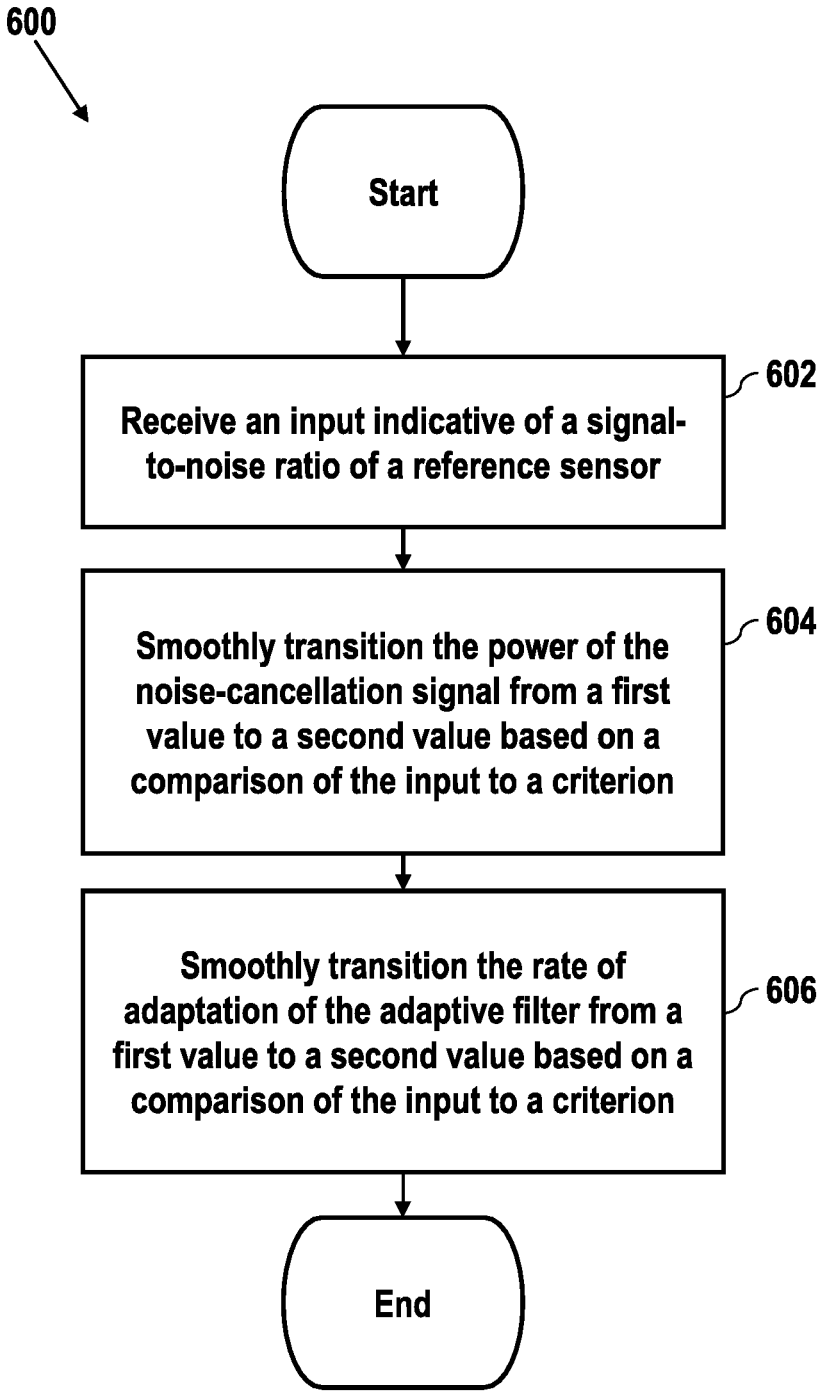
FIG. 6A depicts a flowchart of a method for smoothly transitioning the noise-cancellation signal from a first value to a second value, according to an example.
Figure 6B:
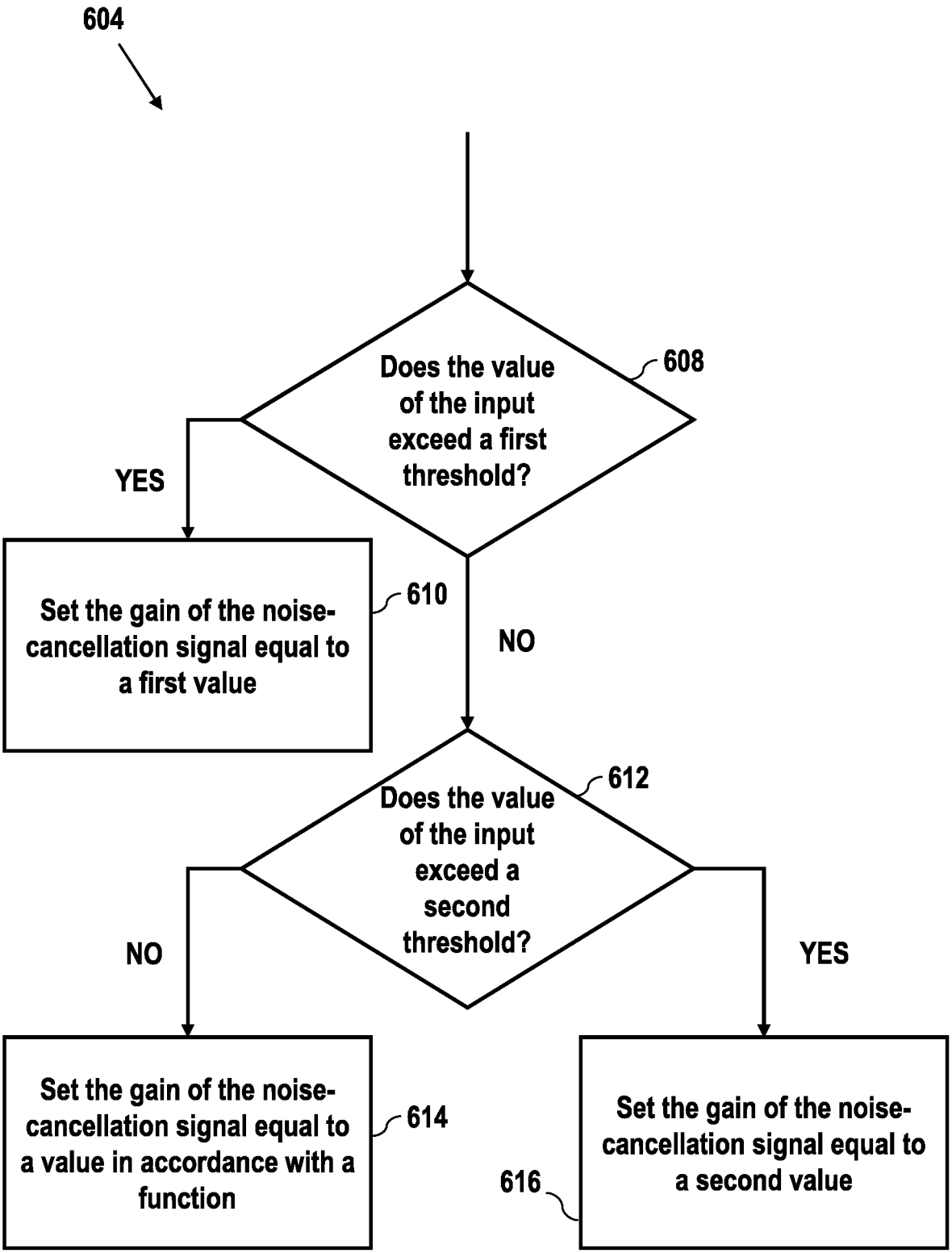
FIG. 6B depicts a flowchart of a method for smoothly transitioning the rate of adaptation of the adaptive filter from a first value to a second value, according to an example.

FIG. 6B depicts an example flowchart of step 604, in which the input is compared to at least two thresholds and set to some intermediate value when between the two thresholds. At step 608, the input (examples of which are described in connection with step 302) is compared to the first threshold (e.g., vehicle speed of ten miles per hour). This is represented by the conditional block 608 asking whether the input exceeds the first threshold. If the value of the input is less than the first threshold, the noise-cancelation signal is set to the first value at step 610. In an example, the first value can be zero or some negligible value (i.e., one that would result in the playing of a noise-cancellation audio signal that would be imperceptible to a user). In alternative examples, however, the first value can be some predetermined non-zero value. As described above, even if the noise level is too low to adapt the adaptive filter, a noise-cancellation signal can be still be played, the adaptive filter, not yet adapting, behaving like a fixed filter (having some set of predetermined or previously-stored coefficients). In this case, the first value may be some small gain value that results in the cancelling of minor road noise in the vehicle cabin during driving at low speeds over most road surfaces.

If the input value is above the first threshold the input is compared to the second threshold value at step 612. This is represented by the conditional block 612 asking whether the input exceeds the second threshold. If the input is above the second threshold, the gain of noise-cancellation signal is set to the second value (e.g., unity) at step 616, which results in the noise-cancellation audio signal being played at a level that results in optimum cancellation. However, if the noise-cancellation signal is below the second threshold, then the gain of the noise-cancellation signal is set to some value in accordance with the predetermined function (e.g., the linear function disclosed in Eq. (11) or a logarithmic function) at step 614. As described above, in an alternative example, the intermediate value can be a predetermined value (e.g., a gain value of 0.5).

Returning to FIG. 6A, at step 606 the rate of adaptation can also be made to smoothly transition from a first value (e.g., zero) to a second value (e.g., unity) based on the comparison of the input representative of the SNR of the reference sensor(s) to a criterion). In an example, this can be implemented by varying the step size gain of the update equation used by the adaptive processing module to update the adaptive filter. When the step size gain is zero, the adaptive processing module will not update the coefficients of the adaptive filter. When the step size gain is at unity, the rate of adaptation is typically set to some optimum level for updating the coefficients of the adaptive filter. Again, smoothly transitioning requires passing through at least one intermediate value between the first value and the second value, although it is contemplated that rate of adaptation could transition through multiple intermediate values on its way from the first value to the second value. The value of the intermediate value can be fixed or can be determined by a function.

In an example, the rate of adaptation of the noise-cancellation filter can be varied according to the following equation:

$$\mu(n)=\mu_0\cdot\mu_{input}(n) \tag{12}$$

where $\mu_0$ is the maximum allowable step size of the adaptive filter and $\mu_{input}(n)$ is an input-dependent step size gain that can be calculated as follows:

$$\mu_{input}(n)=\begin{cases}0, & INP_1(n)\le I_3(n)\\ \dfrac{INP_1(n)-I_3(n)}{I_4(n)-I_3(n)}, & I_3(n)<INP_1(n)<I_4(n)\\ 1, & INP_1(n)\ge I_4(n)\end{cases} \tag{13}$$

Thus, the step size gain is set to zero (causing adaptation to cease) while the input is less than or equal to the third threshold value. The step size gain is set to unity when the input is greater than the fourth threshold value. While the value of the input is between the third and fourth threshold values the step size gain is determined by the linear function shown in Eq. (13). Accordingly, the step size linearly ramps from the first value to the second value as the input value increases. In alternative examples, the intermediate value could be determined by a different function, such as a logarithmic function. In yet another example, the intermediate value could be a fixed value (e.g., 0.5).

Generally speaking, the third threshold is equal to or higher than the second threshold used in step 612 (and described in Eq. 11) in order to ensure that the noise-cancellation audio signal is played at optimal volume before adaptation of the adaptive filter begins. This ensures that the adaptive filter is not updated with an incorrect error signal. In an example, the third threshold could be set to some value lower than second threshold, if some compensation for the incorrect error signal is provided. For example, the error signal could be minimized by some gain value less than one, the error signal gain value being determined by the value of the gain of the noise-cancellation signal.

Figure 6C:
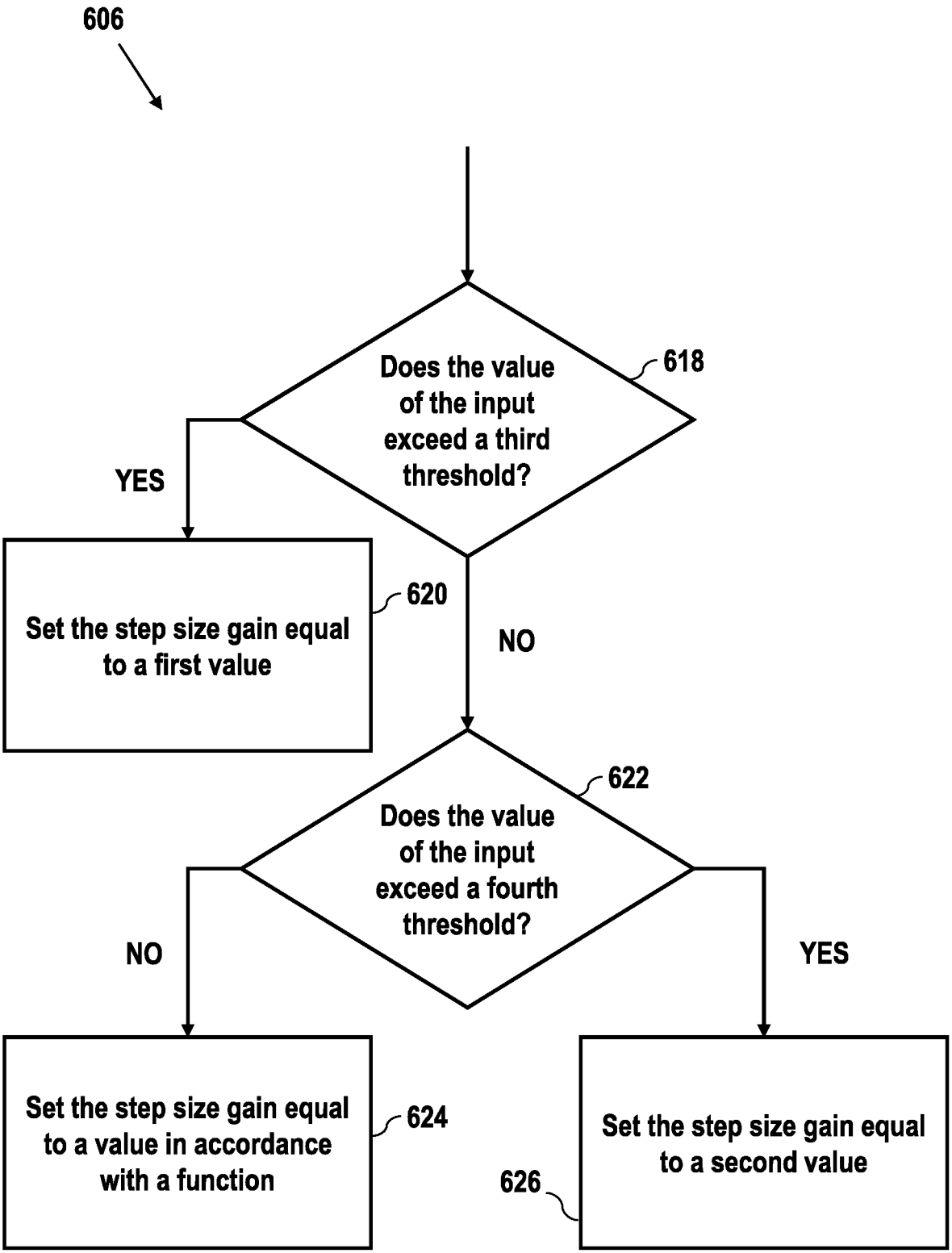
FIG. 6C depicts a flowchart of a method for smoothly transitioning the noise-cancellation signal or rate of adaptation from a first value to a second value, according to an example.

FIG. 6C shows a flowchart of an example implementation of step 616. At step 618, the input (examples of which are described in connection with step 302) is compared to the first threshold (e.g., vehicle speed of 20 miles per hour). This is represented by the conditional block 618 asking whether the input exceeds the third threshold. If the value of the input is less than the third threshold, the step size gain is set to the first value by adjusting the gain of the rate of adaptation at step 620.

If the input value is above the third threshold, at step 622, the input is compared to the fourth threshold value. This is represented by the conditional block 622 asking whether the input exceeds the fourth threshold. If the input is above the fourth threshold, then, at step 626, the step size is set to the second value (e.g., an optimum step size) by adjusting the gain to a second value (e.g., unity). However, if the input is below the second threshold, then at step 624, the gain of the step size is set to some value in accordance with the predetermined function (e.g., the linear function disclosed in Eq. (13) or a logarithmic function). In an alternative example, the intermediate value can be a predetermined value (e.g., a gain value of 0.5).

The flowcharts of FIGS. 6B and 6C each show a single instance of a computer-implemented method that would be run in a loop in order to effect a smooth transition of the noise-cancellation signal and the rate of adaptation, respectively. Indeed, in order to transition from a first value, to a second value through an intermediate value, the method of FIGS. 6B and 6C would need to be run a minimum of three times in a loop to set the gain to a first value, an intermediate value, and a second value, respectively.

Figure 7:
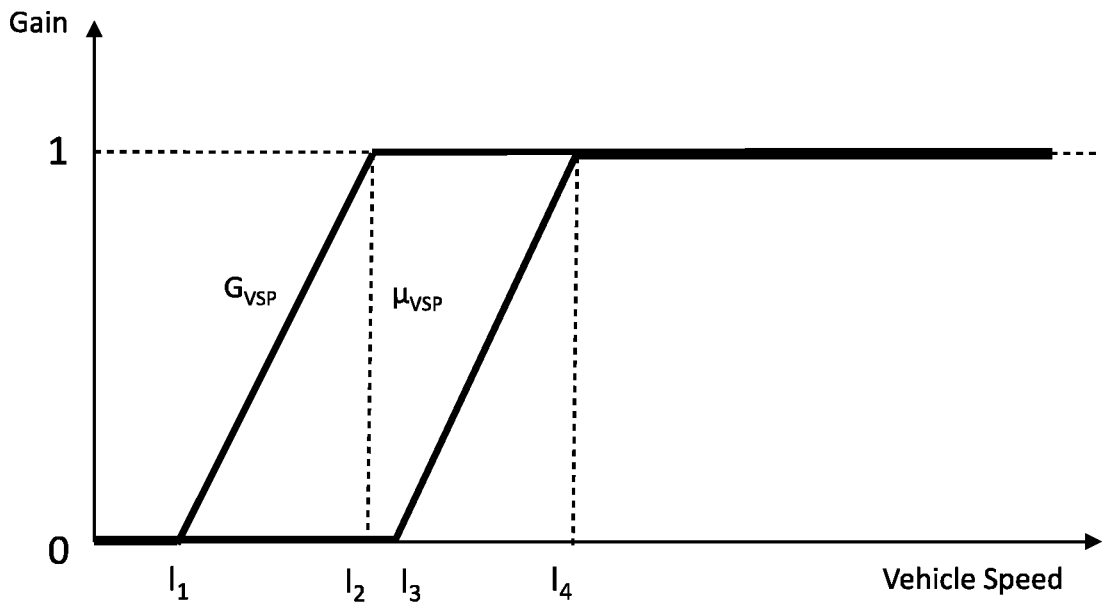
FIG. 7 depicts a graph of transitioning the gain of the noise-cancellation signal and step size from a first value to a second value, according to an example.

FIG. 7 depicts a graph of the gain of the noise-cancellation signal and the step size according to Eqs. (11) and (13) versus an input of vehicle speed. As shown, at the first threshold $I_1$ the gain of the noise-cancellation signal linearly increases until the second threshold $I_2$. Likewise, at the third threshold $I_3$ the gain of the step size linearly increases until the fourth threshold $I_4$. In this example, and as described above, the third threshold is typically higher than or equal to the second threshold.

In an alternative example, to implement a smooth transition, the gain of the noise-cancellation output signal or the step size of the adaptive filter can follow a predetermined sequence to transition from the first value to the second value. For example, once the input exceeds a certain threshold the noise-cancellation system can begin a predetermined sequence that smoothly transitions from the first value to the second through at least one predetermined intermediate value, based on the single instance of exceeding the threshold. The values of the predetermined sequence can follow a predetermined function such as a linear function or a logarithmic function.

This example can be useful for inputs that have large discrete jumps in value rather than a continuous output or small steps in value. For example, if the input is gear position, which typically only has five or six values, the vehicle being in a certain gear (e.g., second gear) can be set as the threshold. It would not be useful to use a higher gear as the next threshold in a smooth transition function (e.g., Eq. (11) or Eq. (13)) because the time between successive gears is too large to result in a transition that a user would perceive as smooth. Accordingly, once the vehicle enters the predetermined gear, the noise-cancellation system can be programmed to transition the noise-cancellation signal and/or the rate of adaptation from the first value to the second value, through at least one intermediate value, without waiting for an additional gear change. This can follow the line of the graph shown in FIG. 7, but only be triggered, e.g., by a single threshold. This example, is, however, not limited to inputs with large discrete jumps and can be used for any type of input indicative of the signal-to-noise ratio of the reference sensor(s).

Furthermore, the thresholds for the smooth transition described in connection with FIGS. 6A-6C can be smoothly transitioned between threshold values. As described in connection with FIG. 6D the threshold values can be transitioned from a first threshold value to a second threshold value to compensate for certain instances in which an input (e.g., vehicle speed) fails to adequately capture the SNR of the reference sensor(s). The thresholds, however, similar to the noise-cancellation signal and the rate of adaptation, can be smoothly transitioned from the first threshold value to the second threshold value. In other words, the threshold values can be transitioned between the first value and the second value through at least one intermediate value. In an example, the threshold values can each be adjusted according to the following equation:

$$I_i(n) = \begin{cases} I_{i_{max}}, & INP_2(n) \le I_{var1} \\ \dfrac{I_{var2} - INP_2(n)}{I_{var2} - I_{var1}}(I_{i_{max}} - I_{i_{min}}) + I_{i_{min}}, & I_{var1} < INP_2(n) < I_{var2} \\ I_{i_{min}}, & INP_2(n) \ge I_{var2} \end{cases} \quad (14)$$

where $I_i(n)$ can be any of thresholds $I_1$-$I_4$, $I_{1max}$ is the maximum value that a given threshold is set, $I_{imin}$ is the minimum value that a given threshold is set, first variance threshold $I_{var1}$ is a first threshold against which the second input is compared and second variance threshold $I_{var2}$ is the second threshold against which the second input is compared.

Similar in operation to Eqs. (11) and (13), when the second input is below the first variance threshold $I_{var1}$, the given threshold is set to its maximum threshold value $I_{1max}$. When the second input is above the second variance threshold $I_{var2}$, the given threshold is set to its minimum threshold value $I_{i_{min}}$. And when the second input is between the first and second variance thresholds, the given threshold is determined by a function that linearly varies, depending on the value of the second input, between the maximum threshold value $I_{i_{max}}$ and the minimum threshold value $I_{i_{min}}$. In this way, the threshold against which the first input is compared can smoothly vary from a maximum value to a minimum value.

As described in connection with FIG. 6D, the second input is not the same type of input as the first input. For example, if the first input is a vehicle speed, the second input can be another type of input, such as power of the reference sensor(s) or a coherence of the reference sensors. Furthermore, the variance thresholds (e.g., $I_{var1}$, $I_{var2}$) for varying the thresholds can varied for each different threshold $I_1$-$I_4$ or can be the same for each threshold $I_1$-$I_4$.

Figure 8:
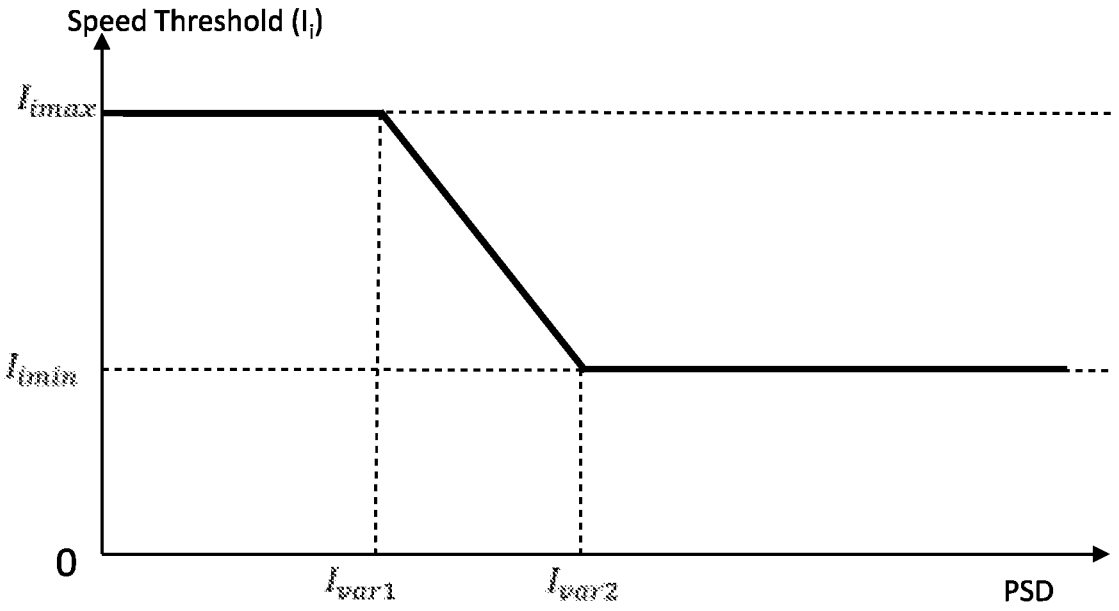
FIG. 8 depicts a graph of smoothly varying the threshold for transitioning the gain of the noise-cancellation signal and the step size from a first value to a second value, according to an example.

FIG. 8 depicts a graph of Eq. (14), in which the first input is vehicle speed and the second input is the power of the reference sensor(s). As shown, while the PSD is less than the first variance threshold $I_{var1}$ the first threshold is held to $I_{i_{max}}$ before linearly transitioning, based on the power of the reference sensor, to the $I_{i_{max}}$ at the second variance threshold $I_{var2}$.

Of course, the function that determines the intermediate value need not be determined by a linear function but can be logarithmic or any other suitable function. Furthermore, the intermediate value can be a constant value between the maximum value and the minimum value (e.g., halfway between the maximum value and the minimum value). Further, the smooth transition need not be dictated by a piecewise equation can be preprogrammed to smoothly transition over a period of time when the second input exceeds the first value.

In each of the above examples described in connection with FIGS. 3A-8, rather than using only a single input (e.g., a first input or a second input) multiple inputs can be used to determine when to transition the noise-cancellation signal or the rate of adaptation or the thresholds used to determine when the transition occurs. Multiple inputs can be used by combining inputs using a logical AND or OR function. For example, rather than using a vehicle speed, a certain gear position AND the engine RPMs above a given threshold can be used to determine what value to set the noise-cancellation signal, the rate of adaptation, or a particular threshold for transition. Alternatively, a logical OR function can be used. In other words, the first threshold can be a certain vehicle speed OR a certain engine RPM value.

For the purposes of this disclosure, any instance of an equation being used to determine a value (e.g., the equations used to determine the intermediate values) can be implemented as a look-up table, the values of which are dictated by the equation, or can be calculated in real time.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A vehicle-implemented noise-cancellation system, comprising:

a noise-cancellation system disposed in a vehicle, the noise-cancellation system comprising an adaptive filter being adjusted according to a reference signal and an error signal, the adaptive filter outputting a noise-cancellation signal, which, when transduced into a noise-cancellation audio signal by a speaker, cancels road noise within at least one zone within a cabin of the vehicle; and an adjustment module configured to vary a power of the noise-cancellation signal or a rate of adaptation of the adaptive filter from a first value to a second value, passing through at least one intermediate value between the first value and the second value, based on a comparison of a signal to a threshold, wherein the signal is indicative of at least one of: a speed of the vehicle, revolutions per minute of an engine of the vehicle, gear position of the engine, and a measure of similarity between outputs of at least two reference sensors.

2. The vehicle-implemented noise-cancellation system of claim 1, wherein the threshold is a fixed threshold.

3. The vehicle-implemented noise-cancellation system of claim 2, wherein the variation of the power of the noise-cancellation signal or the rate of adaptation of the adaptive filter is further based on a comparison of the signal to a second fixed threshold.

4. The vehicle-implemented noise-cancellation system of claim 1, wherein the threshold is a variable threshold, the variation of the variable threshold being based upon a second signal indicative of a signal-to-noise ratio of the reference signal.

5. The vehicle-implemented noise-cancellation system of claim 4, wherein the variation of the power of the noise-cancellation signal or the rate of adaptation of the adaptive filter is further based on a comparison of the signal to a second variable threshold.

6. The vehicle-implemented noise-cancellation system of claim 1, wherein the intermediate value is determined according to a predetermined function of the signal.

7. The vehicle-implemented noise-cancellation system of claim 6, wherein the predetermined function is a linear function.

8. The vehicle-implemented noise-cancellation system of claim 6, wherein the predetermined function is a logarithmic function.

9. A vehicle-implemented noise-cancellation system, comprising:

a noise-cancellation system disposed in a vehicle, the noise-cancellation system comprising an adaptive filter being adjusted according to a reference signal and an error signal, the adaptive filter outputting a noise-cancellation signal, which, when transduced into a noise-cancellation audio signal by a speaker, cancels road noise within at least one zone within a cabin of the vehicle; and an adjustment module configured to vary a power of the noise-cancellation signal or a rate of adaptation of the adaptive filter from a first value to a second value based on a comparison of a signal indicative of a state of the vehicle or a measure of relationship between two or more reference sensor signals to a threshold, wherein the signal indicative of a state of the vehicle is received from an engine computer unit.

10. The vehicle-implemented noise-cancellation system of claim 9, wherein the state of the vehicle is at least one of: a speed of the vehicle, revolutions per minute of an engine of the vehicle, and gear position of an engine of the vehicle.

11. The vehicle-implemented noise-cancellation system of claim 9, wherein the threshold is a fixed threshold.

12. The vehicle-implemented noise-cancellation system of claim 9, wherein the threshold is a variable threshold, the variation of the variable threshold being based upon a second time-varying signal indicative of a signal-to-noise ratio of the reference signal.

13. A computer-implemented method for smoothly transitioning a noise-cancellation system, implemented in a vehicle, from an off state to an on state, comprising:

receiving a signal indicative of a signal-to-noise ratio of a reference sensor of the noise-cancellation system;

comparing a value of the signal to a first threshold, wherein if a value of the signal is less than the first threshold a power of a noise-cancellation signal or a rate of adaptation of the noise-cancellation system is set to a first value, wherein if the value of the signal is greater than the first threshold, performing the step of:

comparing the value of the signal to a second threshold, wherein if the value of the signal is greater than the second threshold, the power of the noise-cancellation signal or the rate of adaptation is set to a second value, wherein if the signal is greater than the first threshold and less than the second threshold the power of a noise-cancellation signal or the rate of adaptation is set to an intermediate value, wherein the second threshold is greater than the first threshold, wherein the signal is indicative of at least one of: a speed of the vehicle, revolutions per minute of an engine of the vehicle, gear position of an engine of the vehicle, and a measure of similarity between outputs of at least two reference sensors.

14. The computer-implemented method of claim 13, wherein the value of the intermediate value is determined according to a predetermined function of the signal.

15. The computer-implemented method of claim 14, wherein the predetermined function is a linear function.

16. The computer-implemented method of claim 14, wherein the predetermined function is a logarithmic function.

17. The computer-implemented method of claim 13, wherein the value of the first threshold and the second threshold are determined according to a second signal indicative of a signal-noise-ratio of the reference sensor.

18. The computer-implemented method of claim 13, further comprising the steps of:

receiving a second signal indicative of a signal-to-noise ratio of the reference sensor;

comparing a value of the second signal to a third threshold, wherein if a value of the signal is less than the third threshold the first threshold is set to a first threshold value, wherein if the value of the second signal is greater than the third threshold, performing the step of:

comparing the value of the second signal to a fourth threshold, wherein if the value of the second signal is greater than the fourth threshold the first threshold is set to a second threshold value, wherein if the second signal is greater than the third threshold and less than the fourth threshold the first threshold is set to an intermediate value, wherein the second threshold is greater than the first threshold.

* * * * *